US006923710B2

(12) United States Patent
Han

(10) Patent No.: US 6,923,710 B2
(45) Date of Patent: Aug. 2, 2005

(54) APPARATUS AND METHOD FOR CHEMICAL MECHANICAL POLISHING PROCESS

(76) Inventor: Jae Won Han, #934-201 Mirinae Maeul Apt., Jung 1-dong, Wonmi-gu, Bucheon-si, Gyeonggi-do 420-710 (KR)

( * ) Notice: Subject to any disclaimer, the term of this patent is extended or adjusted under 35 U.S.C. 154(b) by 0 days.

(21) Appl. No.: 10/909,473

(22) Filed: Aug. 2, 2004

(65) Prior Publication Data

US 2005/0026543 A1 Feb. 3, 2005

(30) Foreign Application Priority Data

Aug. 2, 2003 (KR) ..... 10-2003-0053634

(51) Int. Cl.[7] ..... B24B 1/00

(52) U.S. Cl. ..... 451/5; 451/8; 451/41; 451/57; 451/63; 451/67; 451/285; 451/287

(58) Field of Search ..... 451/5, 57, 8, 41, 451/63, 67, 285, 287; 438/11, 17, 18, 692–693; 324/600; 700/121

(56) References Cited

U.S. PATENT DOCUMENTS 4,764,206 A * 8/1988 Yamashita et al. ..... 504/250
5,970,313 A * 10/1999 Rowland et al. ..... 438/17
6,191,864 B1 2/2001 Sandhu
6,218,306 B1 * 4/2001 Fishkin et al. ..... 438/692
6,293,845 B1 9/2001 Clark-Phelps
6,514,775 B2 2/2003 Chen et al.
6,537,133 B1 3/2003 Birang et al.
6,547,637 B1 4/2003 Zhang
6,612,900 B2 * 9/2003 Moore ..... 451/5
6,657,439 B1 * 12/2003 Harada ..... 324/600
6,743,075 B2 * 6/2004 Lin et al. ..... 451/5
6,848,970 B2 * 2/2005 Manens et al. ..... 451/5

* cited by examiner

*Primary Examiner*—George Nguyen
(74) *Attorney, Agent, or Firm*—Hanley, Flight & Zimmerman, LLC

(57) ABSTRACT

An apparatus and method for chemical mechanical polishing are disclosed. An example apparatus for use with a chemical mechanical polishing (CMP) process includes a polishing part configured to perform a CMP process to a polishing endpoint for a polishing target deposited on a substrate, a cleaning part configured to clean the substrate, and a resistance measurement part configured to measure a sheet resistance of the substrate. The example apparatus also includes a CMP control part configured to determine based on the sheet resistance whether a residual target exists, to estimate re-polishing time, and to control the polishing part to perform a re-polishing process if the residual target exists.

5 Claims, 6 Drawing Sheets

APPARATUS AND METHOD FOR CHEMICAL MECHANICAL POLISHING PROCESS

FIELD OF THE DISCLOSURE

The present disclosure relates generally to semiconductor devices and, more particularly, to an apparatus and method for a chemical mechanical polishing process that may be used to accurately determine whether a thin layer is polished to a predetermined polishing endpoint and to calculate a thickness of residual and re-polishing time.

BACKGROUND

In general, as the degree of integration in semiconductor devices advances, the design rule of the semiconductor device is decreased or miniaturized. As the miniaturization of the design rule rapidly proceeds, the size of a source/drain and the line width of a gate electrode and a metal interconnect decrease in a MOS transistor. Several methods are provided to fabricate a semiconductor having a fine line width. A chemical mechanical polishing (hereinafter referred to as "CMP") process is one of the methods. The CMP process planarizes a layer of a substrate using both a mechanical strength and chemical interaction caused by slurries. The CMP process can polish a layer of a substrate to a precise thickness and uniformly planarizes the whole area of the substrate. Thus, the CMP process is the essential step in a recent process for fabricating a semiconductor device having a fine line width.

In detail, the CMP process comprises the following steps. First, the CMP process is performed in an apparatus such as the example CMP apparatus of FIG. 1. Referring to FIG. 1, the CMP apparatus includes a carrier head 105 for fixing a substrate through absorption. A carrier film 106 is adhered to the bottom portion of the carrier head 105. Thus, the substrate can be held by the carrier film 106. A rotating platen 101 is placed away from the bottom portion of the carrier head at a predetermined distance. A polishing pad 102 is installed on the upper portion of the rotating platen 101. A slurry injection nozzle (not shown) is positioned away from the upper portion of the rotating platen 101 at a predetermined distance. Here, the slurry nozzle supplies slurries during polishing. A pad conditioner 104 apart from the carrier head 105 is installed on the predetermined portion over the polishing pad.

Upon the starting of the polishing process, the rotating platen 101 begins to spin. Next, the carrier head 105 may move downward until the polishing pad 102 on the rotating platen 101 contacts with the substrate 103 adhered to the carrier film 106. After the substrate contacts with the polishing pad, a self-rotation movement and a horizontal fluctuation movement are carried out by a predetermined device (not shown). While the self-rotation movement and the horizontal fluctuation movement are carried out, slurry is blown from the slurry injection nozzle. The blown slurry is then supplied to the polishing pad. Therefore, a mechanical polishing is performed along with a chemical polishing, which is caused by a chemical reaction between the slurry and the pattern of the thin layer of the substrate 103. After the CMP process is performed, the pattern of thin layer deposited over the substrate is polished to a predetermined thickness and the planarization completed. Meanwhile, a policy for determining the polishing endpoint of a polishing target such as the pattern of the thin layer should be provided for the CMP process. A desired semiconductor device can be then fabricated by predicting the polishing endpoint and performing the CMP process to the endpoint.

FIG. 2 illustrates, in a cross-sectional view, an embodiment of the process for fabricating a semiconductor device according to the prior art. Referring to FIG. 2, a first metal interconnect 202 is formed on a substrate 201. An interlayer dielectric layer 203 having a via hole is formed on the first metal layer. Here, the via hole is formed to be in contact with the first metal layer 202. Next, a predetermined metal layer such as a tungsten layer is deposited over the whole area including the via hole to make a plug. Here, the plug is an electric device to connect the first metal layer and a second metal layer which will be deposited through a later process. Next, the plug is then made by the planarization of the tungsten layer through the CMP process. Here, a polishing endpoint is the surface of the interlayer dielectric layer during the CMP process for the tungsten layer.

At present, two methods are largely used to detect the polishing endpoint. One method is an end point detection (hereinafter referred to as "EPD") method that uses the material characteristics between the polishing target and the layer under the polishing target. The second method is to measure the polishing thickness by manipulating a polishing speed calculated based on the inherent polishing degree of the polishing target material.

According to the first method, a predetermined gas is blown to the polishing area during the CMP process to determine whether the bottom layer of the target such as an etch stop layer is detected or not. If the etch stop layer is detected, the CMP process should be stopped. However, because the CMP process is stopped only after the etch-stop layer is detected, the unwanted thickness of the etch stop layer is inevitably polished.

The second method is prevalently adopted for the present CMP process. The second method can calculate the accurate polishing speed for the polishing target by using the characteristics of the CMP apparatus such as the rotation speed of the CMP apparatus and the polishing degree of each material. Therefore, the polished thickness is determined on the basis of the polishing speed.

However, the polishing amount of the target can deviate from the required thickness due to the state of the material or the CMP apparatus. The characteristics of the semiconductor device may be deteriorated. Thus, after the CMP process is completed, the polishing degree of the target should be measured.

At present, two methods are provided to measure the polishing degree after the completion of the CMP process. First, an operator visually confirms the polishing degree with a microscope. A second method is to move the polished substrate to a resistance measurement apparatus to determine the accuracy of the polished thickness.

According to the conventional method, the resistance measurement apparatus apart from the CMP apparatus or the bare eye inspection of the operator is used to confirm whether the polishing target has been accurately planarized to a predetermined endpoint or not. However, according to the resistance measurement apparatus, the yield of a semiconductor device may decrease due to the movement step of the polished substrate to the resistance measurement apparatus. Moreover, the visual check cannot guarantee reproducibility and accuracy.

U.S. Pat. No. 6,547,637 to Zhang et al., discloses a device and method for detecting endpoints of a chemical-mechanical polishing process for semiconductor wafers. U.S. Pat. No. 6,537,133 to Birang et al. discloses an apparatus and method of chemical mechanical polishing (CMP) of a wafer employing a device for determining, in-situ, during the CMP process, an endpoint where the process is to be terminated. U.S. Pat. No. 6,514,775 to Chen et al. discloses in-situ techniques for determining process end points in semiconductor wafer polishing processes. U.S. Pat. No. 6,293,845 to Clark-Phelps et al. discloses a method and system for detecting a planarization endpoint of a semiconductor wafer planarization operation, which includes monitoring a motor current, a carousel motor and a head motor. U.S. Pat. No. 6,191,846 to Opsal et al. discloses an apparatus for characterizing multilayer samples comprising an intensity modulated pump beam and a probe beam.

DETAILED DESCRIPTION

Figure 1:
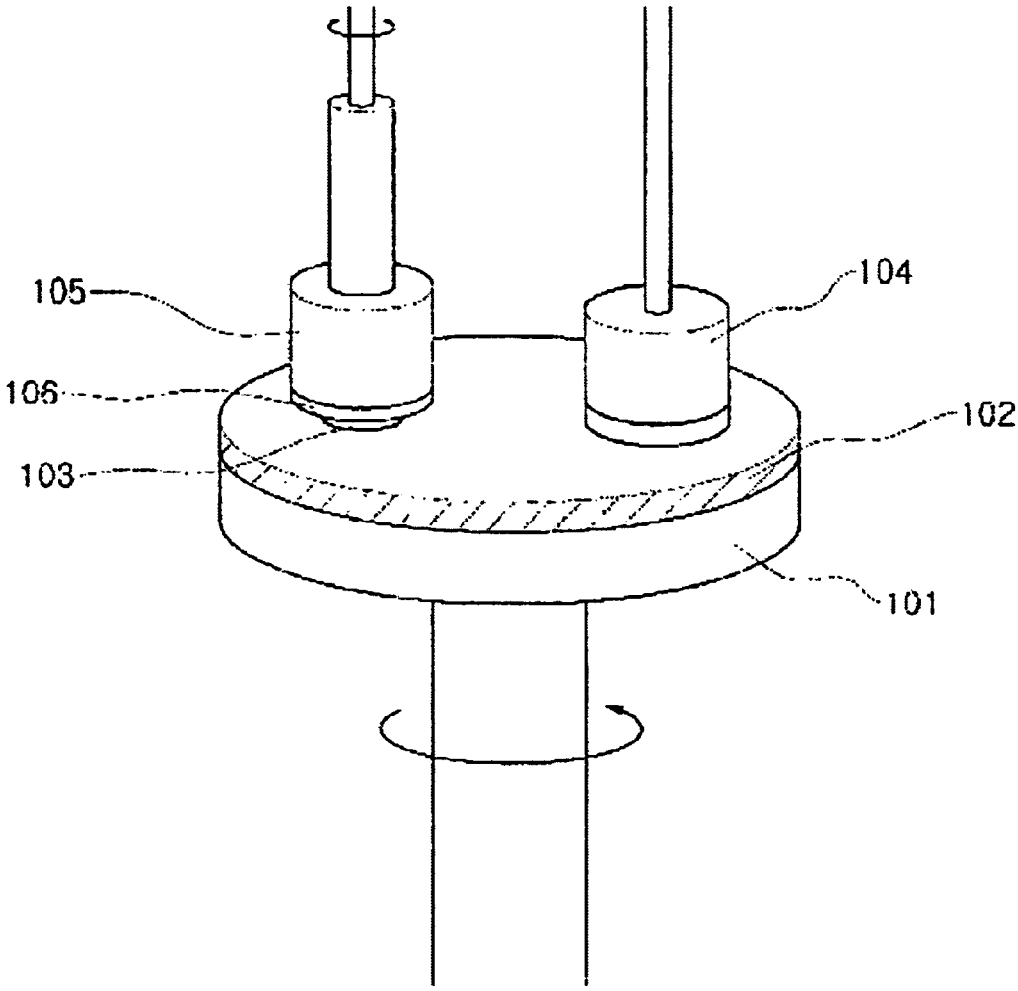
FIG. 1 illustrates an embodiment of a typical CMP apparatus.
Figure 2:
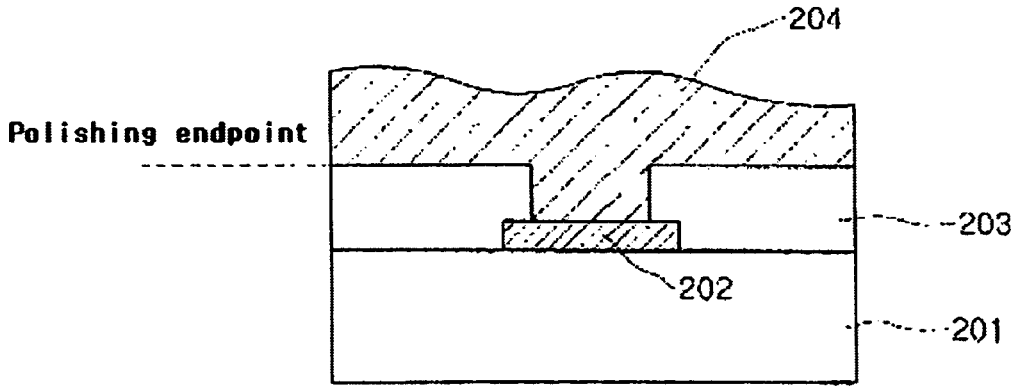
FIG. 2 illustrates, in a cross-sectional view, an embodiment of a known process for fabricating a semiconductor device according to the prior art.

As described in greater detail below, an example apparatus and method for a chemical mechanical polishing process may be used to accurately determine whether a thin layer is polished to a predetermined polishing endpoint and to calculate thickness of residual target and re-polishing time. An example apparatus for a CMP process includes a resistance measurement part to measure the resistance of a substrate. The apparatus confirms the polishing degree with the resistance measured by the resistance measurement part. If the substrate is not polished to the desired polishing endpoint, the thickness of the residual target may be calculated and the re-polishing time may be then estimated. A re-polishing process for the residual target is then performed.

Another example apparatus for the CMP process comprises a polishing part for a CMP process to a polishing endpoint for a polishing target deposited on a substrate, a cleaning part for cleaning the substrate polished through the CMP process, a resistance measurement part for measuring the sheet resistance of the substrate cleaned through the cleaning process and a CMP control part for determining by means of the sheet resistance calculated by the resistance measurement part whether a residual target exists or not, estimating re-polishing time and controlling the polishing part to perform a re-polishing process if the residual target exists.

Preferably, the CMP control part comprises a residual thickness calculation module for calculating the thickness of the residual target with the sheet resistance measured by the resistance measurement part and the specific resistance of the polishing target, a saving module for saving the information such as the specific resistance corresponding to the thickness of the materials of the polishing target, the thickness of the residual target and the polishing degree and the polishing speed for each material, a polishing time estimation module for estimating re-polishing time with the information such as the polishing speed and the thickness of the residual target and a control module for controlling the linkage of the modules, determining whether the residual target exists or not by means of the sheet resistance measured by the resistance measurement part, transferring the re-polishing time to the polishing part and making the polishing part perform a re-polishing process if the residual target exist.

In addition, an example method for the CMP process comprises performing a CMP process for a polishing target on a substrate to a polishing endpoint, measuring the sheet resistance of the substrate, determining whether a residual target exists or not by measuring the sheet resistance, calculating the thickness of the residual target by using the sheet resistance and the specific resistance of the polishing target material, estimating re-polishing time by using the thickness of the residual target and the polishing speed for the polishing target material and performing a CMP process for the polishing target on the substrate during the re-polishing time. Preferably, the method further comprises cleaning the substrate before the sheet resistance is measured. Also, preferably, the polishing target on the substrate comprises at least one metallic material.

The resistance measurement part can determine whether the polishing is complete or not. If the residual target exists, the thickness of the residual target and the re-polishing times can be accurately calculated. As a result, the polishing target will be completely removed.

Figure 3:
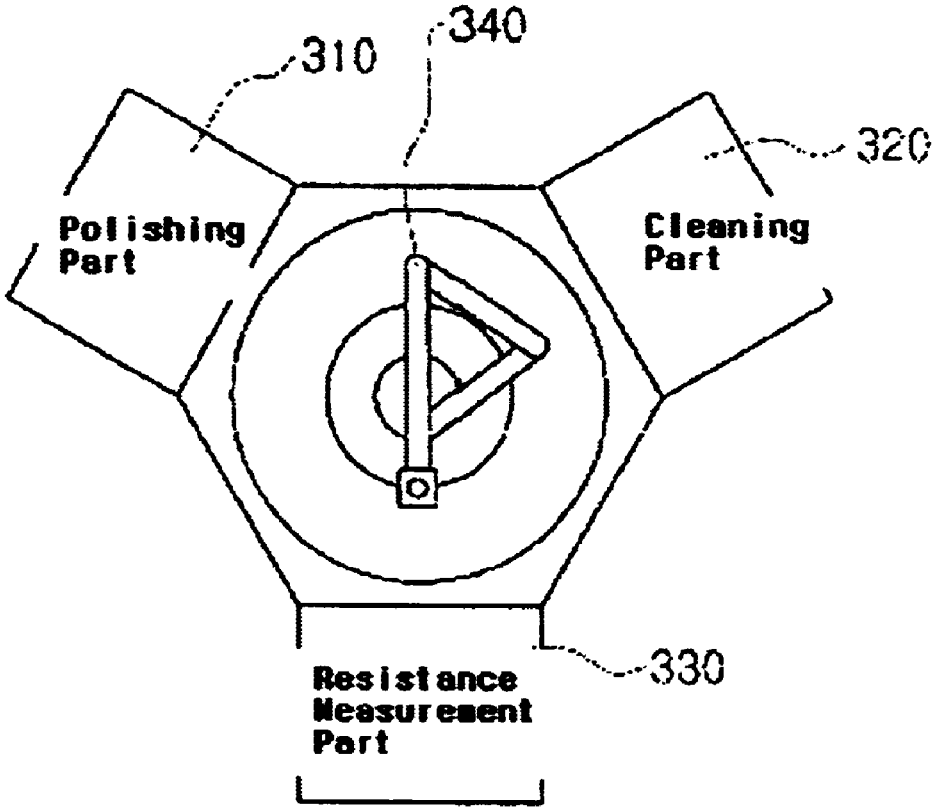
FIG. 3 illustrates, in a top-view, an example of a CMP apparatus according to one embodiment.

FIG. 3 illustrates, in a top-view, an example embodiment of the CMP apparatus. Referring to FIG. 3, an example apparatus for a CMP process comprises a polishing part 310, a cleaning part 320 and a resistance measurement part 330. The polishing part 310, the cleaning device 320 and the resistance measurement part 330 have independent spaces. A transferring part 340 may be installed in a predetermined area such as the center of the CMP apparatus. Here, the transferring part 340 moves a substrate among the above three parts. A typical CMP process is performed in the polishing part 310, which polishes a polishing target deposited on the substrate to a predetermined polishing endpoint. The polishing part 310 is equipped with basic devices required to perform a polishing process, as shown in FIG. 1. In detail, the polishing part 310 has a polishing pad 102, a rotating platen 101, a carrier head 105 and the slurry injection nozzle. The polishing pad 102 is installed on the upper portion of the polishing device 310. The rotating platen 101 is rotated by means of a predetermined drive unit. The carrier head 105 fixes a substrate away from the upper portion of the rotating platen at a predetermined distance through absorption. The slurry injection nozzle supplies slurry to the polishing pad.

The cleaning part 320 performs a cleaning process for the substrate transferred by the predetermined transferring part 340 after the polishing part completes a CMP process. The cleaning part 320 cleans the substrate by removing residuals and remainders produced from polishing before the resistance measurement part, described later, measures the resistance of the substrate. A common cleaning device such as spin-scrubber (not shown) may be used for the cleaning part 320. The resistance measurement part 330 measures the resistance of the substrate for which the cleaning process has been performed. Here, the resistance measurement part 330 confirms whether the polishing target deposited on the substrate is accurately polished to a predetermined endpoint or not.

Figure 4:
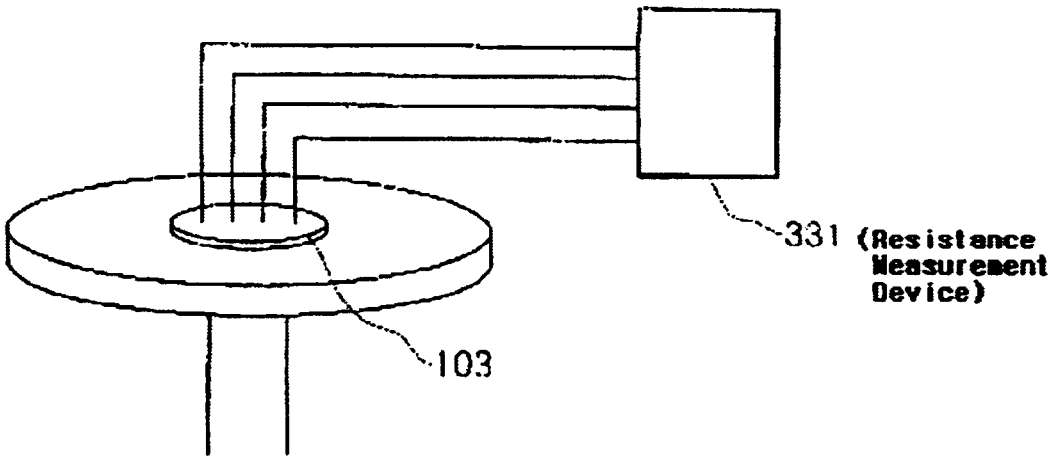
FIG. 4 illustrates an example embodiment of the resistance measurement part.

In detail, the resistance measurement part 330 determines by measuring the sheet resistance of the surface of the substrate whether the polishing target remains or not. If the polishing target is found to be incomplete, the thickness of the residual target will be measured. FIG. 4 illustrates one embodiment of the resistance measurement part. Referring to FIG. 4, a predetermined device 331 such as a device having four resistance measurement terminals is installed in the resistance measurement part 330. The sheet resistance of the substrate is measured by the predetermined device. For example, the CMP process is performed for a metallic layer as the polishing target. The sheet resistance of the surface of a substrate is then measured. For example, if the residual target of the metal layer exists on the substrate, the low value of sheet resistance may be measured. If the metal layer is completely polished and an insulating layer under the metal layer is then exposed, the value of the sheet resistance may be high because the sheet resistance of the insulating layer was measured. Thus, the objective to determine whether the polishing target remains or not can be achieved. Moreover, the thickness of the residual target can be measured by the measured sheet resistance. The details will be explained later. The polishing part 310, the cleaning part 320 and the resistance measurement part are linked and controlled by a CMP control part 500. The detailed configuration and operation principle of the CMP control part are an essential part in the present invention.

Figure 5:
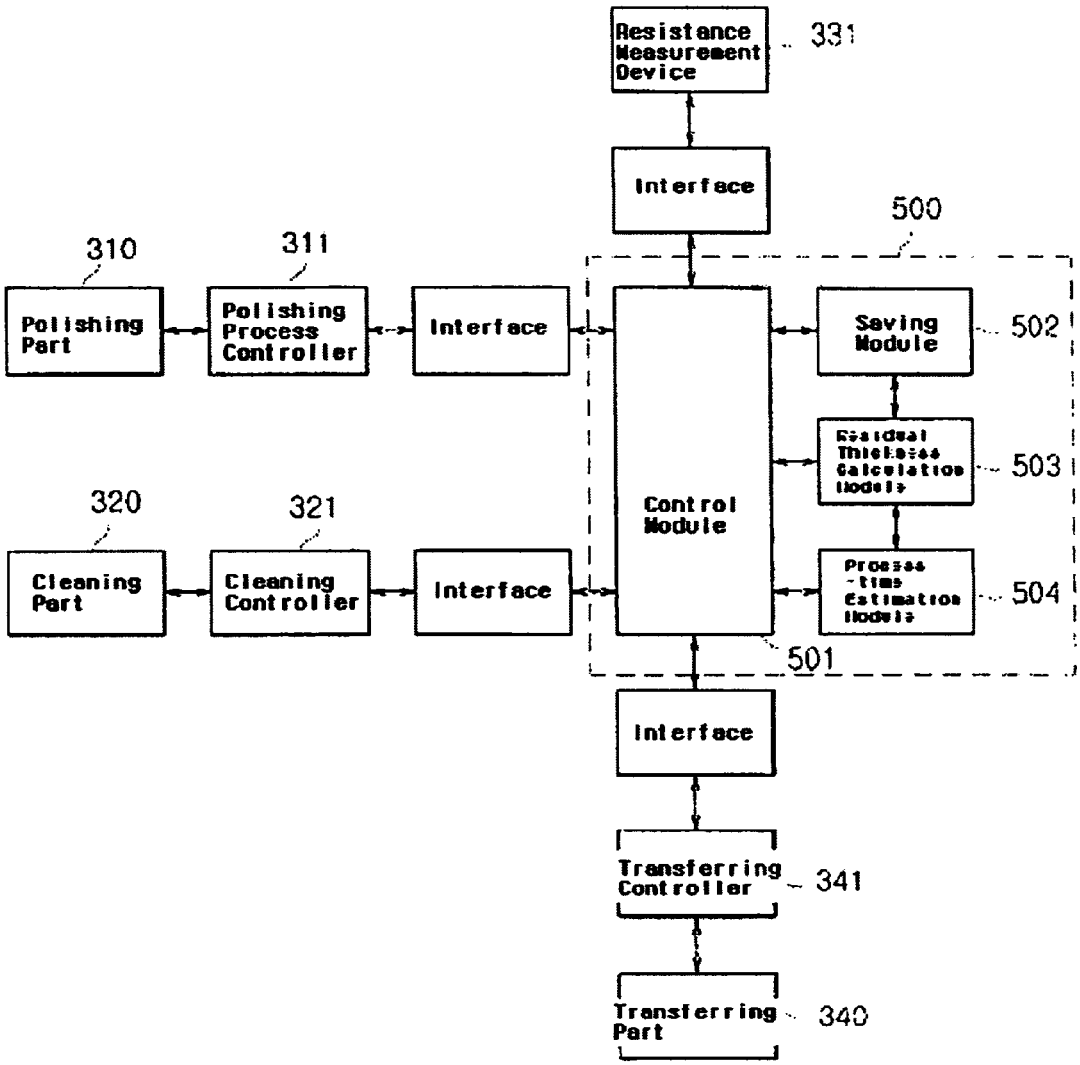
FIG. 5 illustrates an example embodiment of the CMP apparatus.

FIG. 5 illustrates an example CMP apparatus according to one embodiment. Referring to FIG. 5, the CMP control part 500 comprises a residual thickness calculation module 503, a saving module 502, a process time estimation module and a control module for globally controlling all the modules.

The residual thickness calculation module 503 calculates the thickness of the residual target if the residual target exists. The method for calculating the thickness of the residual target comprises following steps. First, the sheet resistance of the substrate is measured by the resistance measurement device 331 such as the device having four resistance measurement terminals. The data on the sheet resistance of the substrate is then transmitted to the CMP control part 500 through an interface. The thickness of the residual target is then calculated by Equation 1 below.

$$t=\rho/Rs \qquad \text{Equation 1}$$

(t: thickness of the residual target, ρ: specific resistance Rs: sheet resistance)

Referring to Equation 1, the value of the specific resistance of a material is not a fixed value. For example, as the thickness of a material for the thin layer decreases, the value of the inherent specific resistance of the material may be changed. Thus, thin layers with various thickness should be fabricated and the sheet resistance of each layers should be measured. Furthermore, the values of the sheet resistance of materials corresponding to the thickness of the each thin layer should be calculated by measuring the thickness of each thin layer through a SEM (Scanning Electron Microscopy) or a TEM (Transmission Electron Microscopy) in advance.

The thickness of the residual target is accurately calculated by measuring the sheet resistance. Here, the sheet resistance is measured by the resistance measurement device 331 with the value of the specific resistance corresponding to the thickness of the thin layer. For example, if metal is used as a polishing target and the thickness of the residual target measured by the residual thickness calculation module 503 is close to 'zero', the measured sheet resistance will be infinitely large. Because the target is completely polished and the sheet resistance of the insulating layer under the target is measured, the sheet resistance would infinitely be large. If the measured thickness of the residual target is a predetermined value, the polishing target made of metal will remain on the substrate. Thus, the thickness information will help in determining whether the polishing target remains or not. Here, the thickness information is created by the residual thickness calculation module.

The saving module 502 saves information such as thickness information, the degree of polishing and the polishing speed information. Here, the thickness information is created by the residual thickness calculation module. The information for the polishing degree and the polishing speed is created by the experiment for the polishing target made of various materials deposited on the substrate in advance. In addition, various programs including correction formulas required to calculate the polishing speed and the thickness are saved in the saving module, thereby input and output function being performed under the control of the control module. As a reference, the polishing speed of the materials is calculated with the characteristics of the device such as the inherent polishing degree of each material and the rotating speed of the polishing part in the CMP apparatus.

The process-time estimation module calculates the time to re-polish the residual target to the polishing endpoint using information includes the thickness of the residual target and the polishing speed which are saved in the saving module.

The control module 501 globally controls the data flow and the linkage of the module for calculating thickness, the saving module and the process-time estimation module. Additionally, the control module also receives and transmits data to the CMP control part and an outside device.

The control module 501 of the CMP control part is coupled to the resistance measurement device 331 of the resistance measurement part, the polishing process controller 311 of the polishing part 310, the cleaning controller 321 of the cleaning part 320 and a transferring controller 341 by an interface such as, for example, an RS232C-based local area network (LAN). Here, the polishing process controller 311, the cleaning controller 321, the transferring controller 341 control the polishing part 310, the cleaning part 320 and the transferring part 340 to perform the corresponding processes.

If the communication connection is configured in the CMP apparatus, the control module 501 of the CMP control part sends the information to the transferring controller 341 and the polishing process controller 311. Here, the information comprises the thickness of the residual target and the re-polishing time that are prepared by the residual thickness calculation module 503 and the process time estimation module 504. Next, the transferring part moves the substrate placed on the resistance measurement part to the polishing part 310. Next, the CMP process is again performed for the substrate transferred to the polishing part 310 for the length of the calculated re-polishing time.

Figure 6:
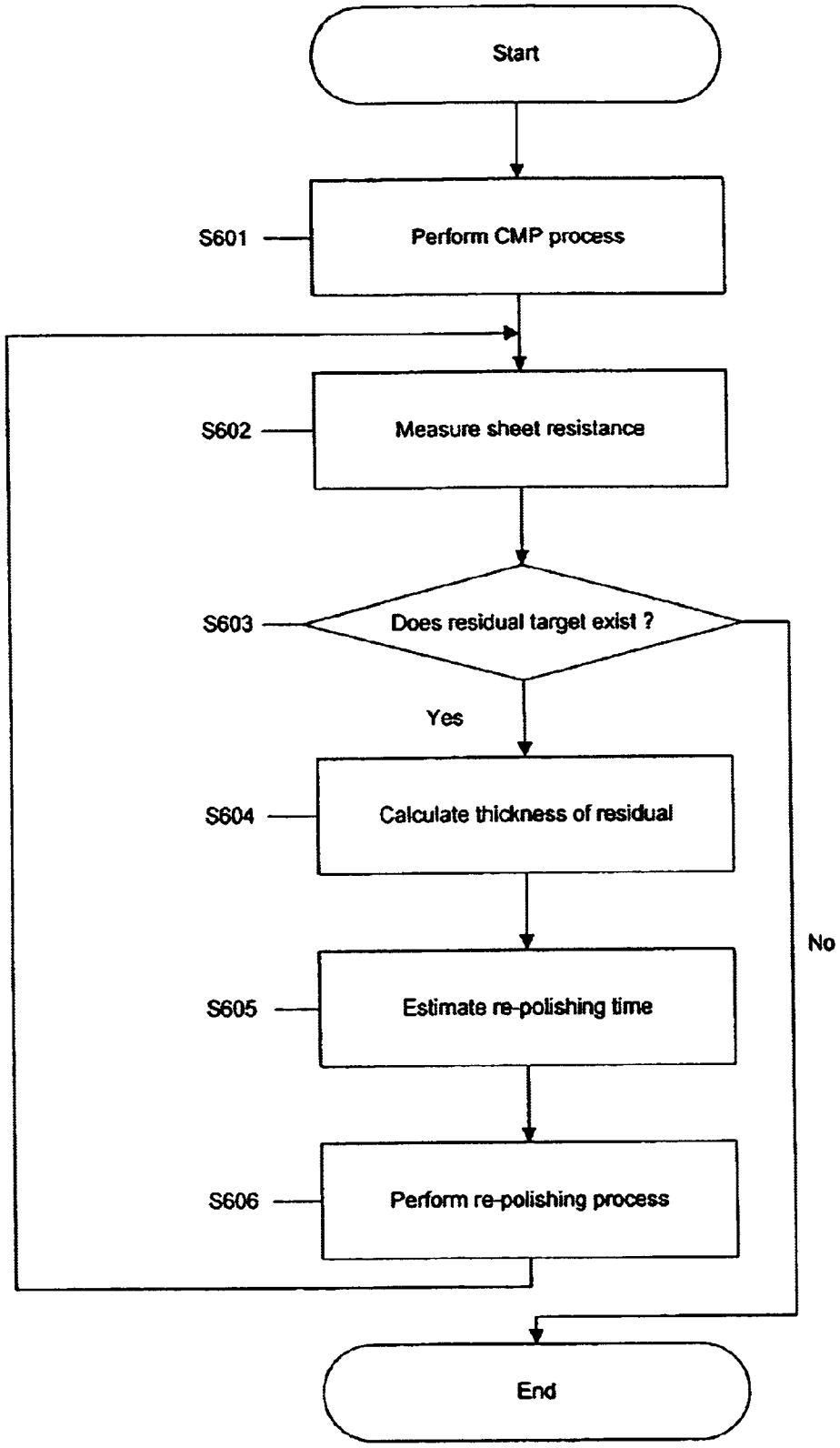
FIG. 6 illustrates an example flowchart of a CMP method according to one embodiment.

The method for the CMP process according to one embodiment comprises the operations illustrated in the flowchart of FIG. 6. Referring to FIG. 6, a predetermined material is deposited on a substrate. The substrate is loaded to the CMP apparatus. The polishing part then performs the CMP process for the material on the substrate under the control of the CMP control part 500 (S601). Here, the thickness of the material to be polished is determined and saved in the CMP control part before the load of the substrate on the polishing part or after the deposition of the material. Next, the polishing part polishes the material on the substrate with the predetermined thickness information saved on the CMP control part. The transferring part 340 then moves the polished substrate to the cleaning part 320 under the control of the CMP control part after the polishing process is performed in the polishing part 310. The contaminants remaining on the substrate such as residuals are removed by the cleaning part such as spin-scrubber. Next, the resulting substrate is transferred to the resistance measurement part 330. The control module 501 transmits the measurement signal to the resistance measurement device of the resistance measurement part such as a four resistance measurement terminal through an interface. Next, the resistance measurement device measures the sheet resistance of the surface of the substrate. The information for the value of the sheet resistance is then transmitted to the control module of the CMP control part (S602).

Next, the control module determines through the linkage of the saving module and the thickness of the residual calculating module whether the polishing target remains or not (S603). If the residual target exists, the thickness of the residual target will be calculated with the information of the specific resistance corresponding to the thickness of thin layers (S604). If the polishing target is completely polished and no residual target exists, the CMP process will be terminated.

If the thickness of the residual target is calculated, the control module will estimate the re-polishing time for the polishing target with predetermined information (S605). Here, the predetermined information comprises the thickness and the polishing speed of the residual target which are created by the linkage of the saving module and the process time estimation module under the control of the control module.

Next, the control module of the CMP control part transfers the re-polishing time to the polishing process controller of the polishing part. A re-polishing process is then performed for the residual target on the substrate (S606). Here, the substrate loaded on the resistance measurement part is moved to the polishing part under the control of the control module in advance before the re-polishing process.

After the completion of the re-polishing process, the sheet resistance of the substrate is again measured (S602) after the above-mentioned cleaning process and resistance measurement process. If no residual target exists, the substrate will be moved and the later processes will be performed. If the residual target still remains on the substrate, the residual thickness calculation process and the re-polishing time estimation process will be performed. As a result, the polishing target will be completely removed by calculating the exact thickness of the residual target and estimating the re-polishing time.

Accordingly, the example apparatus and methods disclosed herein may be used to determine by measuring the sheet resistance of the substrate whether the polishing target is completely polished or not. Additionally, if the residual target exists, the example apparatus and methods disclosed herein may be used to improve the reliability of the CMP process by accurately calculating the thickness of the residual target and estimating the re-polishing time.

Although certain methods and apparatus have been described herein, the scope of coverage of this patent is not limited thereto. To the contrary, this patent covers all embodiments fairly falling within the scope of the appended claims either literally or under the doctrine of equivalents.

What is claimed is:

1. An apparatus for use with a chemical mechanical polishing (CMP) process comprising:

a polishing part configured to perform a CMP process to a polishing endpoint for a polishing target deposited on a substrate;

a cleaning part configured to clean the substrate;

a resistance measurement part configured to measure a sheet resistance of the substrate; and a CMP control part configured to determine based on the sheet resistance whether a residual target exists, to estimate re-polishing time, and to control the polishing part to perform a re-polishing process if the residual target exists.

2. The method as defined by claim 1, wherein the CMP control part comprises:

a residual thickness calculation module configured to calculate a thickness of the residual target based on the sheet resistance measured by the resistance measurement part and a specific resistance of the polishing target;

a saving module configured to save information including at least one of a specific resistance associated with the polishing target, the thickness of a residual target, a polishing degree, or a polishing speed;

a polishing time estimation module configured to estimate re-polishing time based on at least one of the polishing speed or the thickness of the residual target; and a control module configured to control a linkage of the modules, to determine whether the residual target exists based on the sheet resistance, to transfer the re-polishing time to the polishing part, and to make the polishing part perform a re-polishing process if the residual target exists.

3. A method for a chemical mechanical polishing (CMP) process comprising:

performing a CMP process for a polishing target on a substrate to a polishing endpoint;

measuring a sheet resistance of the substrate;

determining whether a residual target exists based on the sheet resistance;

calculating the thickness of the residual target based on the sheet resistance and the specific resistance of the polishing target material;

estimating re-polishing time based on the thickness of the residual target and the polishing speed for the polishing target material; and performing a CMP process for the polishing target on the substrate during the re-polishing time.

4. The device as defined by claim 3, further comprising cleaning the substrate before the sheet resistance is measured.

5. The device as defined by claim 3, wherein the polishing target on the substrate comprises at least one metallic material.

* * * * *